US007443987B2

(12) United States Patent
Griesinger

(10) Patent No.: US 7,443,987 B2
(45) Date of Patent: Oct. 28, 2008

(54) DISCRETE SURROUND AUDIO SYSTEM FOR HOME AND AUTOMOTIVE LISTENING

(75) Inventor: David H. Griesinger, Cambridge, MA (US)

(73) Assignee: Harman International Industries, Incorporated, Northridge, CA (US)

( * ) Notice: Subject to any disclaimer, the term of this patent is extended or adjusted under 35 U.S.C. 154(b) by 583 days.

(21) Appl. No.: 10/254,031

(22) Filed: Sep. 23, 2002

(65) Prior Publication Data

US 2003/0206639 A1 Nov. 6, 2003

Related U.S. Application Data

(60) Provisional application No. 60/377,696, filed on May 3, 2002.

(51) Int. Cl.
*H04R 5/00* (2006.01)

(52) U.S. Cl. ..... 381/20; 381/1; 381/27

(58) Field of Classification Search ..... 381/20, 381/19, 21, 22, 23, 300, 307, 27, 1, 18, 339
See application file for complete search history.

(56) References Cited

U.S. PATENT DOCUMENTS

| | | | | |
|---|---|---|---|---|
| 4,862,502 A | | 8/1989 | Griesinger | |
| 5,109,419 A | | 4/1992 | Griesinger | |
| 5,136,650 A | | 8/1992 | Griesinger | |
| 5,161,197 A | | 11/1992 | Griesinger | |
| 5,579,396 A | | 11/1996 | Iida et al. | |
| 5,594,800 A | * | 1/1997 | Gerzon | 381/20 |
| 5,610,986 A | * | 3/1997 | Miles | 381/27 |
| 5,757,927 A | * | 5/1998 | Gerzon et al. | 381/20 |
| 5,761,315 A | | 6/1998 | Iida et al. | |
| 5,796,844 A | | 8/1998 | Griesinger | |
| 5,799,094 A | | 8/1998 | Mouri | |
| 5,870,480 A | | 2/1999 | Griesinger | |
| 6,016,473 A | * | 1/2000 | Dolby | 704/500 |
| 6,108,430 A | | 8/2000 | Kurisu | |
| 6,683,962 B1 | | 1/2004 | Griesinger | |
| 6,694,027 B1 | * | 2/2004 | Schneider | 381/20 |

(Continued)

FOREIGN PATENT DOCUMENTS

JP 02-052000 A2 1/1990

(Continued)

OTHER PUBLICATIONS

International Search Report for corresponding Patent Cooperation Treaty Application No. PCT/US03/13934, dated Dec. 5, 2003, 4 pages.

(Continued)

*Primary Examiner*—Vivian Chin
*Assistant Examiner*—Con P Tran
(74) *Attorney, Agent, or Firm*—Brinks, Hofer, Gilson & Lione

(57) ABSTRACT

A sound processing system increases the robustness of surround sound in various playback situations. The system may process an incoming signal, such as a five channel surround sound signal, with a first and a second matrix. The first and second matrices produce outputs signals from the input incoming signals. At least one of the output signals may be combined before being sent to the speakers.

77 Claims, 7 Drawing Sheets

U.S. PATENT DOCUMENTS

| | | | |
|---|---|---|---|
| 6,697,491 | B1 | 2/2004 | Griesinger |
| 2004/0005064 | A1 | 1/2004 | Griesinger |
| 2004/0005066 | A1 | 1/2004 | Griesinger |
| 2004/0022392 | A1 | 2/2004 | Griesinger |

FOREIGN PATENT DOCUMENTS

| | | | |
|---|---|---|---|
| JP | 04-088200 | A2 | 3/1992 |
| JP | 03-108900 | A2 | 5/1992 |
| JP | 080-51698 | | 2/1996 |
| JP | 11-220797 | A2 | 8/1999 |
| JP | 2000-059897 | A2 | 2/2000 |
| WO | WO9804100 | | 1/1998 |

OTHER PUBLICATIONS

Griesinger, David, "Practical Processors and Programs for Digital Reverberation", *Proceedings of the 7th International Conference of the Audio Engineering Society*, Toronto, May 1989, pp. 187-195.

Griesinger, David, "Multichannel Matrix Surround Decoders for Two-Eared Listeners", *Presented at the101st Convention of the Audio Engineering Society*, Los Angeles, Nov. 8-11, 1996, Reprint # 4402, 21 pages.

Griesinger, David, "Spaciousness and Envelopment in Musical Acoustics", *Presented at the 101st Convention of the Audio Engineering Society*, Los Angeles, Nov. 8-11, 1996, Reprint # 4401, 23 pages.

Griesinger, David, "Speak Placement, Externalization, and Envelopment in Home Listening Rooms", *Presented at the 105th Convention of the Audio Engineering Society*, San Francisco, 1998, Reprint # 4860, 48 pages.

Griesinger, David, "General Overview of Spatial Impression, Envelopment, Localization, and Externalization",*Proceedings of the 15th International Conference of the Audio Engineering Society on Small Room Acoustics*, Denmark, Oct. 31-Nov. 2, 1998, pp. 136-149.

Griesinger, David "Theory and Design of a Digital Audio Processor for Home Use", *J. Audio Eng. Soc.*, vol. 37, No. 1/2, 1989, pp. 40-50.

Griesinger, David, "Binaural Techniques for Music Reproduction" *Proceedings of the 8th International Conference of the Audio Engineering Society*, 1990, pp. 197-207.

Griesinger, David, "Improving Room Acoustics Through Time Variant Synthetic Reverberation", *Presented at the 90th Convention of the Audio Engineering Society*, Paris, Feb. 1991, Reprint # 3014, 27 pgs.

Griesinger, David, "Room Impression Reverberance and Warmth in Rooms and Halls", *Presented at the 93rd Convention of the Audio Engineering Society*, San Francisco, Nov. 1992, Reprint #3383, 21 pgs.

Griesinger, David, "Measures of Spatial Impression and Reverberance Based on the Physiology of Human Hearing", *Proceedings of the 11th International Audio Engineering Society Conference*, May 1992, pp. 114-145.

Griesinger, David, "IALF—Binaural Measures of Spatial Impression and Running Reverberance", *Presented at the 92nd Convention of the Audio Engineering Society*Mar. 1992, Reprint #3292, 42 pgs.

Griesinger, David, "Stereo and Surround Panning in Practice", *Presented at the 112th Convention of the Audio Engineering Society*, Munich, May 2002, 6 pages.

Griesinger, David, "Progress in 5-2-5 Matrix Systems", *Presented at the 103rd Convention of the Audio Engineering Society*, New York, Sep. 1997, 34 pages.

Griesinger, David, "Multichannel Sound Systems and Their Interaction with the Room", *Presented at the 15th International Conference of the Audio Engineering Society*, Copenhagen, Oct. 1998, pp. 159-173.

Griesinger, David, "How Loud Is My Reverberation?", *Presented at the 98th Convention of the Audio Engineering Society*, Paris, Feb. 1995, 11 pages.

Griesinger, David, "Spaciousness and Localization in Listening Rooms and Their Effects on the Recording Technique", *J. Audio Eng. Soc.*, vol. 34, No. 4, 1986, pp. 255-268.

Griesinger, David, "The Psychoacoustics of Apparent Source Width, Spaciousness and Envelopment in Performance Spaces", *Acta Acoustics*, vol. 83, 1997, pp. 721-731.

Griesinger, David, "Surround: The Current Technological Situation", *SMPTE Journal*, 2001, pp. 857-866.

Griesinger, David, "Feedback Reduction and Acoustic Enhancement Using an Inexpensive Digital Sound Processor", *Presented at the 15th International Congress on Acoustics*, Trondheim, Jun. 1995, pp. 473-476.

Griesinger, David, "The Science of Surround", *Presentation material from a speech given at McGill University*, copyright by David Griesinger, Sep. 1999, 69 pages.

Griesinger, David, "Recent Experiences With Electronic Acoustic Enhancement in Concert Halls and Opera Houses", material from David Griesinger's Internet Home Page, obtained from the Internet at: <www.world.std.com/~griesngr...>, undated but prior to May 2002, 9 pages.

Griesinger, David, "The Theory and Practice of Perceptual Modeling—How to use Electronic Reverberation to Add Depth and Envelopment Without Reducing Clarity", material from David Griesinger's Internet Home Page, obtained from the Internet at: <www.world.std.com/~griesngr...>, undated but prior to May 2002, 28 pages.

Griesinger, David, "Internet Home Page", obtained from the Internet at: <www.world.std.com/~griesngr/>, printed on Apr. 26, 2004.

Notification of the First Office Action from the State Intelectual Property Office Of P.R.C. dated Aug. 17, 2007 for Chinese patent No. 038014556.

* cited by examiner

DISCRETE SURROUND AUDIO SYSTEM FOR HOME AND AUTOMOTIVE LISTENING

CROSS REFERENCE TO RELATED APPLICATION

The present application is a continuation of U.S. Provisional Patent Application Ser. No. 60/377,696, filed May 3, 2002, which is incorporated by reference herein.

BACKGROUND OF THE INVENTION

1. Field of the Invention

The invention relates to sound systems, and more specifically to surround sound systems adapted to home and automotive systems.

2. Background of the Invention.

Sound systems may include one or more channels from which the sound may be perceived. Single channel sound systems produce a non-dimensional sound that does not allow the listener to localize the sound. With two-channel reproduction of sound, localization may occur, but horizontal localization may be poor unless the listeners are centered between the speakers. Even so, the difference between a two-channel reproduction of sound and single-channel reproduction may be perceived and appreciated throughout the room.

In practice, most listeners may not be precisely centered between the loudspeakers. Presumably two channels are used because both localization and room sound reproduction are enhanced with more loudspeakers and more discrete channels. The two-channel loudspeaker system in a relatively non-reverberant room may create a realistic spatial field when the listeners face a particular direction. Typically, the sound field may seem spacious to the listeners when the listeners face forward. Conversely, the sound field may collapse when the listeners face to a side.

A common standard for the production and playback of sound recordings with more than two discrete channels uses five discrete channels and an additional band limited low frequency channel. Recordings are mixed by assuming the listener is located at the center of an array of loudspeakers, placing three speakers in front of the listener and two speakers behind the listener. The front speakers are referred to as left front, center, and right front. The rear speakers are referred to as left surround and right surround.

Such 5.1 surround sound mixing may be adequate if the listener is positioned in exactly the center of a symmetric loudspeaker array. Such positioning, however, is almost never achieved. The average listener moves around, and the average home sound system is rarely arranged exactly as desired. When the listener moves away from the center of the speaker array, e.g. moves away from the listening point, if the original recording does not use the center speaker, the front sound image may collapse. The front sound image may collapse to the nearest loudspeaker, similar to the way the sound image collapsed with the two-channel stereo.

Likewise, in an automotive environment, the listener is not positioned in the exactly the center of a symmetric loudspeaker array. In an automobile there is no listener in the center of the space. Because of the seating restrictions in the automobile, every listener is close to at least one of the loudspeakers. In an automobile the sound appears to come from the speaker nearest to the listener, and the spatial reproduction is poor or non-existent.

In addition, if the center channel is used in the recoding, sound from the center channel, that is output from a speaker located in the front and center of the automobile, will appear to come from the right of the driver and the left of the passenger. In this listening environment, the sound from the center channel will not be heard by passengers located in the rear of the automobile.

In addition, in the past, many sound mixers have used only two front channels, and do not use the center channel of a 5.1 surround sound system. These mixers tend to produce recordings that are basically "quadraphonic" by distributing equally into the left front and right front channels important sounds that are intended to sound from the center of a sound-image, and ignore the discrete center channel. There exists a reasonably large catalogue of such quadraphonic recordings from the 1970's and 1980's that are slowly becoming available as 5-channel recordings, but lack programming information for the center channel.

Thus, for at least the above identified reasons relating to listening environment and products, listener position, and sound recordings, there exists a need for a system to improve the localization and the spatial illusion of the sound to produce a more robust sound.

SUMMARY

A sound system is provided that processes discrete channels coming from a commercial multi-channel reproduction media, e.g., Dolby Digital, AC-3, DTS, MLP and the like, and other channels such as stereo, quadraphonic and the like. The system may improve the localization and the spatial illusion of the sound to produce a more robust sound. The system works well in various applications such as home and automotive applications.

The sound system processes an input to produce multi-channel output signals. The system may utilize one or more matrices. For example, the output signal from a two-channel input to seven-channel output matrix may be mixed with the output signal of a two-channel input to four-channel output matrix, to produce seven output channels. A first two-channel to multi-channel matrix may operate on an input front left signal and an input front right signal. Another two-channel to multi-channel matrix may operate on an input surround left signal and an input surround right signal. Other combinations of the number of input channels and output channels may be used. A delay circuit may be included to produce a delayed mix of one or more original channels.

The combination of these matrices may produce a multi-channeled output sound with increased localization robustness and increased spatial effect. The system may provide an enlarged listening area. The system may provide for tolerance of non-ideal speaker placement. The system may also provide for heightened spatial illusion and sound image, and the ability to overcome shortcomings in the original recorded material.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

Moreover, in the figures, like reference numerals designate corresponding parts throughout the different views. In the drawings.

DETAILED DESCRIPTION

Figure 1:
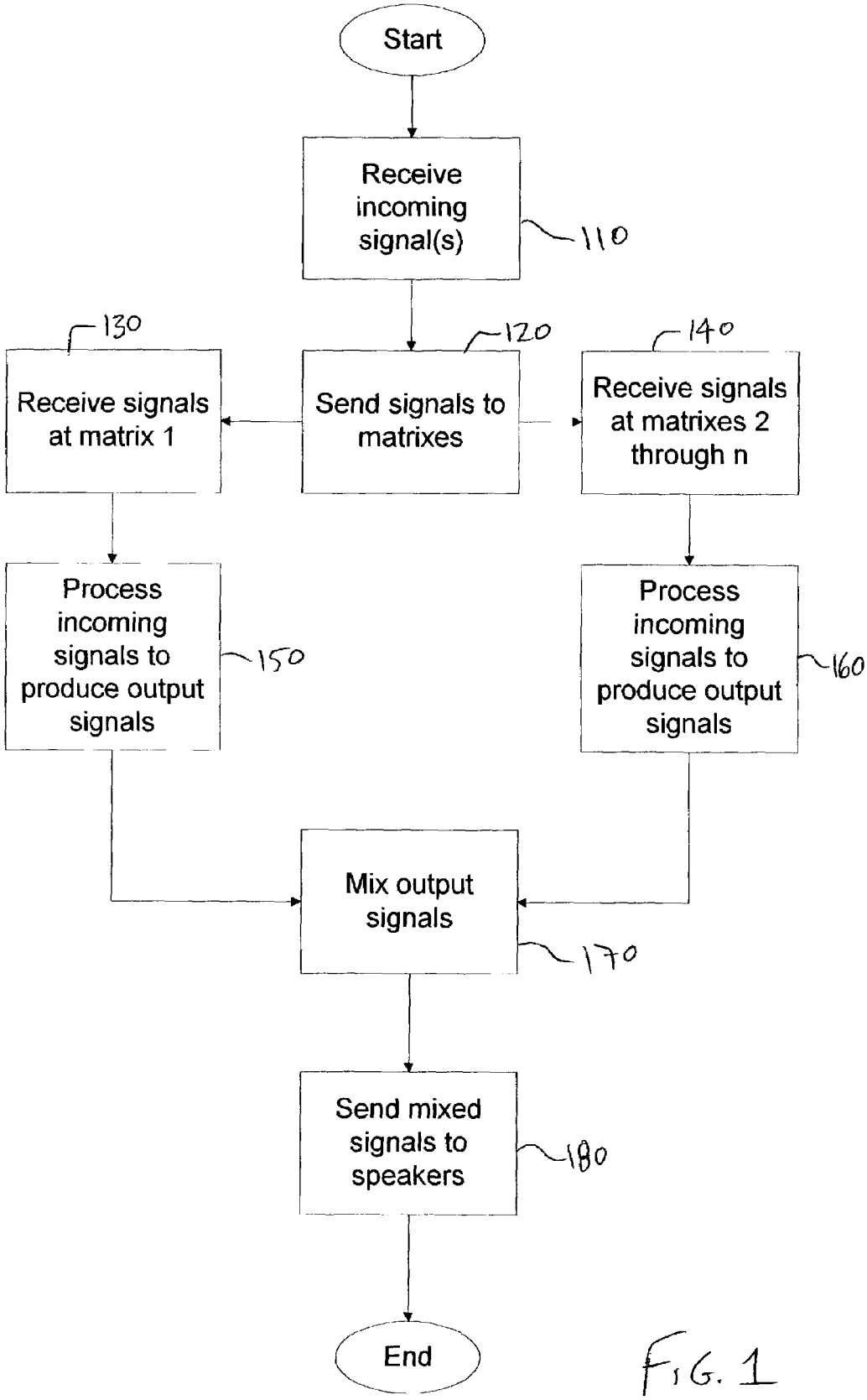
FIG. 1 is a flow chart illustrating a methodology for sound processing an incoming signal.

FIG. 1 is a flow chart 100 of a methodology for sound processing an incoming signal, such as an audio signal, to enhance the perceptions of sounds output to a listener. While a particular configuration and operation are shown, other configurations may be used with fewer or additional components or operations. At block 110, the sound processing system receives an incoming signal, or signals, to process.

The incoming signals may include five channels, such as a surround sound signal having input center, input front left, input front right, input surround left and input surround right channels. The five channel incoming signal may have been previously recorded as a five channel signal or may have been a decoded signal. The five channel recording may be stored on a medium, such as a compact disc (CD) or a tape. Commercial five channel signals include Dolby Digital, AC-3, DTS, and MLP. While a five channel incoming signal is discussed, the sound processing system may also process other amounts of input signals and/or channels, such as a two channel stereo signal and a four channel quadraphonic signal.

Spatial properties of sound may be important to listener satisfaction. In general, there are two types of listener perceptions relating to the spatial aspects of reproduced sound: the perception of the direction of a sound, called localization, and the perception of the type of space in which the recording was produced.

At block 120, the incoming signals are processed with one or more sound matrices. The sound matrices 1-*n* are sound processors that may contain hardware, firmware and/or software algorithms to perform functions such as mixing, decoding, filtering and/or gain enhancement. Exemplary sound matrices include a Logic7® matrix and a 5.1Logic7® matrix, both manufactured by Lexicon located in Bedford, Mass. Other sound matrices may be used such as a Dolby Digital sound matrix. For explanation purposes, two sound matrices are used to process the incoming signals, described below. However, other configurations of matrices may be used.

At block 130, matrix 1 receives selected channels of the incoming signal, and at block 140, matrix 2 receives selected channels of the incoming signal. More than one matrix 1-*n* may be used and the matrices 1-*n* may receive the same or different channels of the incoming signal. For example, matrix 1 may receive a left front channel and a right front channel and matrix 2 may receive a left surround channel and right surround channel. The matrices 1-*n* may have the same or differing sound processing algorithms. For example, matrix 1 may utilize the Logic7® matrix and matrix 2 may utilize a 5.1Logic7. Other sound matrices such as Dolby Digital and other combinations of matrices may be used. For example, two of the same matrices may be used.

At block 150, sound matrix 1 processes the incoming signals to produce one or more output signals. At block 160, sound matrix 2 processes the incoming signals to produce one or more output signals. Alternate to or in conjunction with using sound matrices to process the signals, the incoming signals may be mixed or enhanced by various other algorithms, such as Dolby Digital, to provide outputs for an enhanced perception of sound to the listener. For example, the input center channel may be mixed with the front left and right, and rear left and right channels, in varying degrees.

At blocks 170 and 180, the output signals may be combined or mixed before being sent to the speakers. For example, the side left output of matrix 1 may be combined with the left side output of matrix 2, and the rear left output of matrix 1 may be combined with the rear left output of matrix 2, etc. In addition, the input center channel may be combined with the center output signal of matrix 1. Alternatively, the output signals may be mixed at the speakers, or not mixed at all. After the mixing is complete, one or more output signals may result. Seven output signals may result, but other multiples of output signals also may result. At block 180, the mixed output signals are sent to speakers, for output to a listener.

Figure 2:
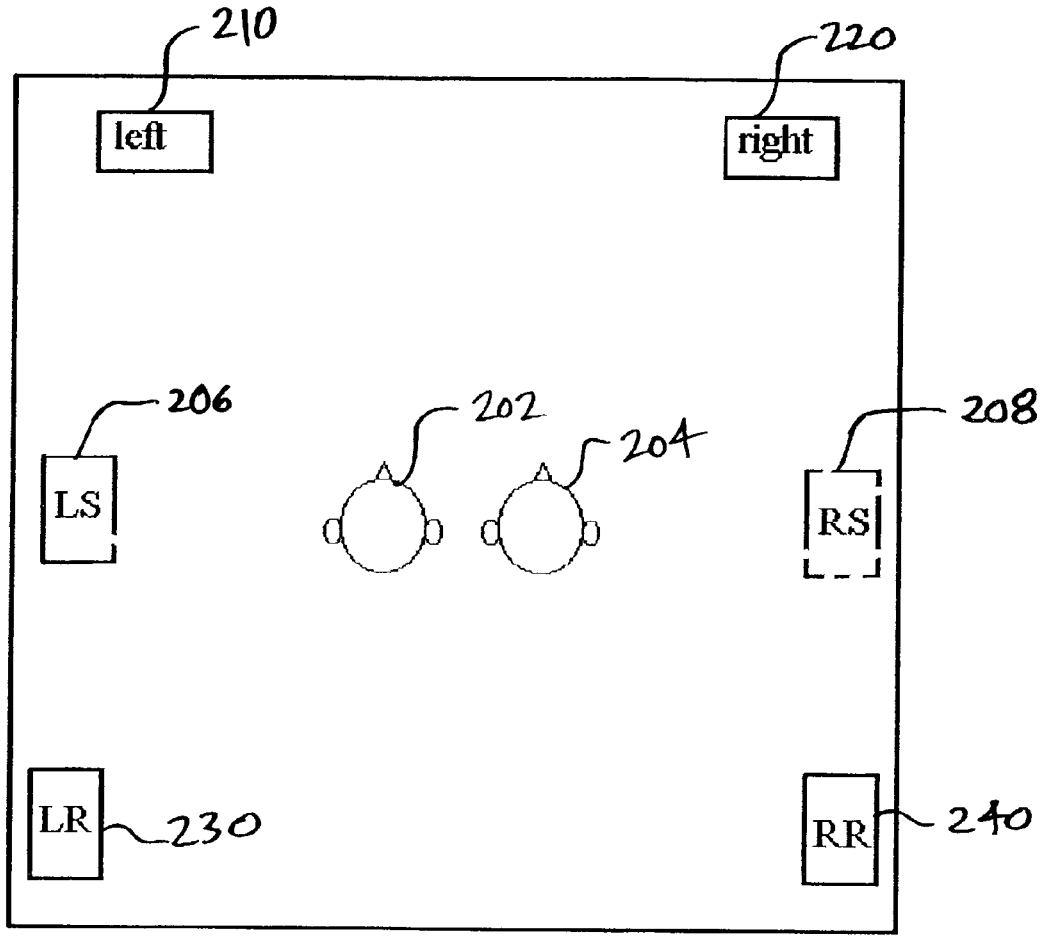
FIG. 2 is a block diagram illustrating exemplary sound systems.

FIG. 2 is a block diagram illustrating exemplary sound systems. As listeners 202, 204 face forward, in a two speaker sound system a left speaker 206 is located to the left of the listeners 202, 204 and a right speaker 208 is located to the right of the listeners 202, 204. The terms "speaker" and "loudspeaker" are interchangeable and mean the same thing, a device for producing sounds. A four-channel system may include a left front speaker 210, a right front speaker 220, a left rear speaker 230 and a right rear speaker 240. The four speakers 210, 220, 230 and 240 may break the symmetry limit of the two-channel system since, with four speakers, sound in the room sound may become uniform in all directions.

Figure 3:
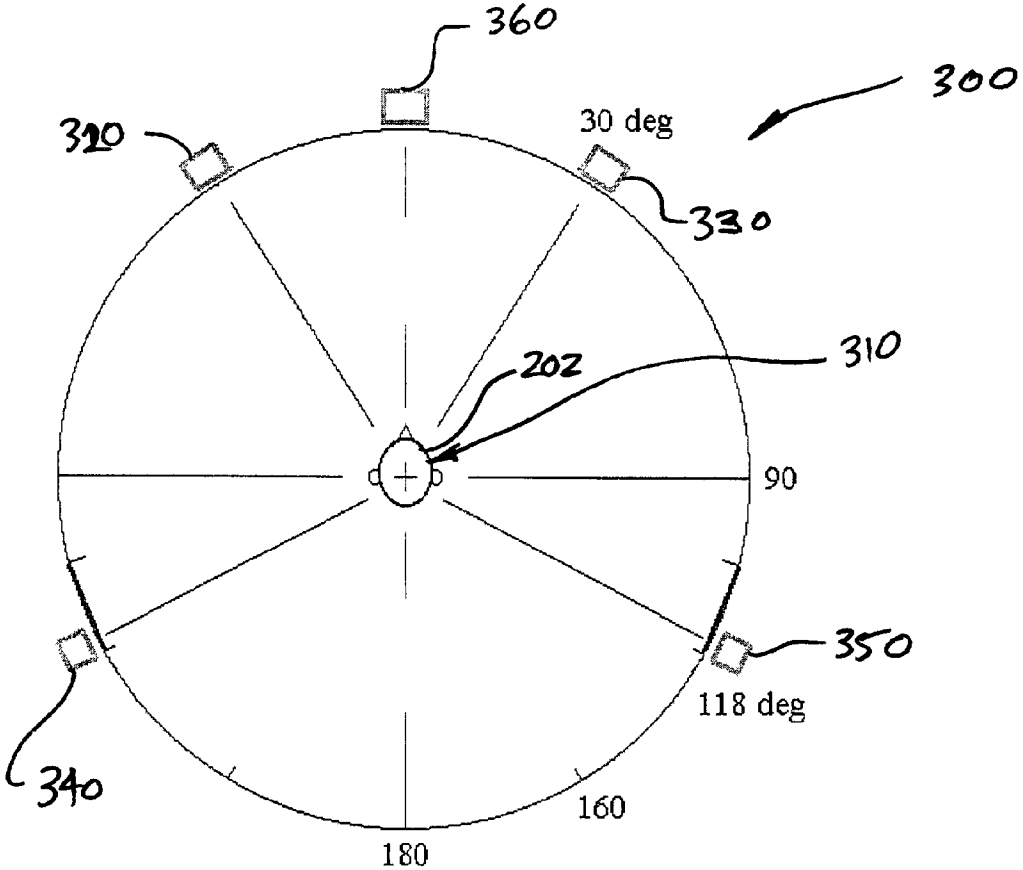
FIG. 3 is a block diagram showing an audio layout for a five-channel audio system.

FIG. 3 is a block diagram showing a speaker layout 300 and a listening point 310 for a five-channel sound system. The sound processing system described herein is applicable for a variety of sound systems, including home and automobile audio systems. The systems described herein are by way of example only. The five-channel system may include a left front speaker 320, a right front speaker 330, a left rear speaker 340, a right rear speaker 350 and a center speaker 360. For a surround sound listener 202 at the center of the standard array, i.e., listening point 310, localization may be improved. The listener 202 may localize discrete sounds from behind the listener 202. Sounds in the front of the listener 202 may be presented to the listener 202 either with two-channel sound mixing, or by including the center channel speaker 360. The sense of space may also be better reproduced, because the addition of the left rear speaker 340 and right rear speaker 350 behind the listener 202 may allow a sound field to be created that sounds spacious regardless of how the listener 202 rotates.

Figure 4:
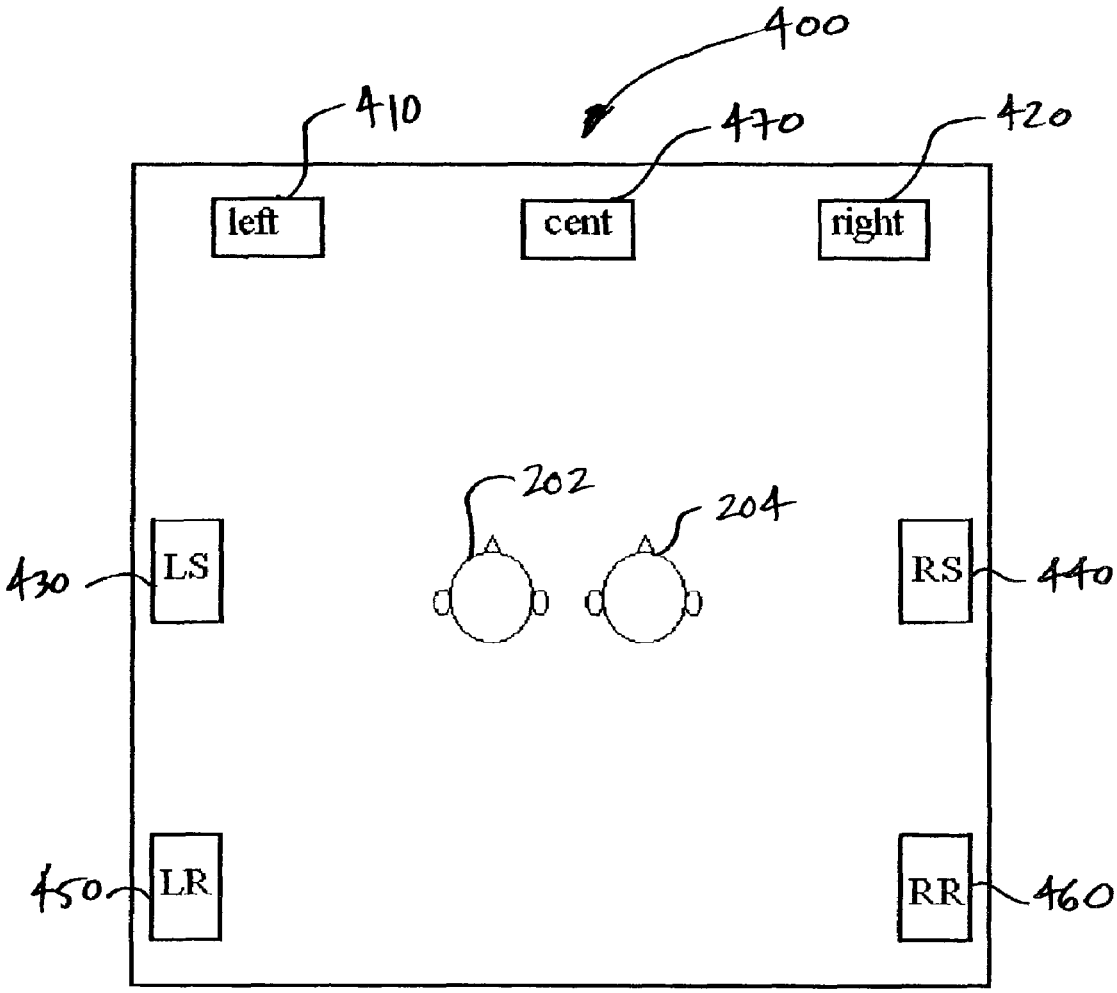
FIG. 4 is a block diagram showing a top view of a layout for a seven-channel home audio system.

A seven-channel audio system may also be provided. FIG. 4 is a block diagram showing a top view of a layout for a seven-channel home audio system 400. Localization and spatial sound illusions may appear more robust in a seven-channel sound system 400, than a sound system with fewer channels. With a multi-channel system, a sense of space may be even more robust, throughout the room, if the original recording contains reverberation that is "decorrelated" or different in all four of the left/right channels. This decorrelation may be high at all frequencies, including frequencies below 300 Hz.

The seven-channel sound system 400 for the home may include a left front speaker 410, a right front speaker 420, a left side speaker 430, a right side speaker 440, a left rear speaker 450, a right rear speaker 460 and a center speaker 470. The left side speaker 430 and the right side speaker 440 may be located substantially to the left and right of the listeners 202, 204. The left front speaker 410, front right speaker 420 and center speaker 470 may be located in front of the listeners 202, 204. The left rear speaker 450 and right rear speaker 460 may be located behind the listeners 202, 204.

Figure 5:
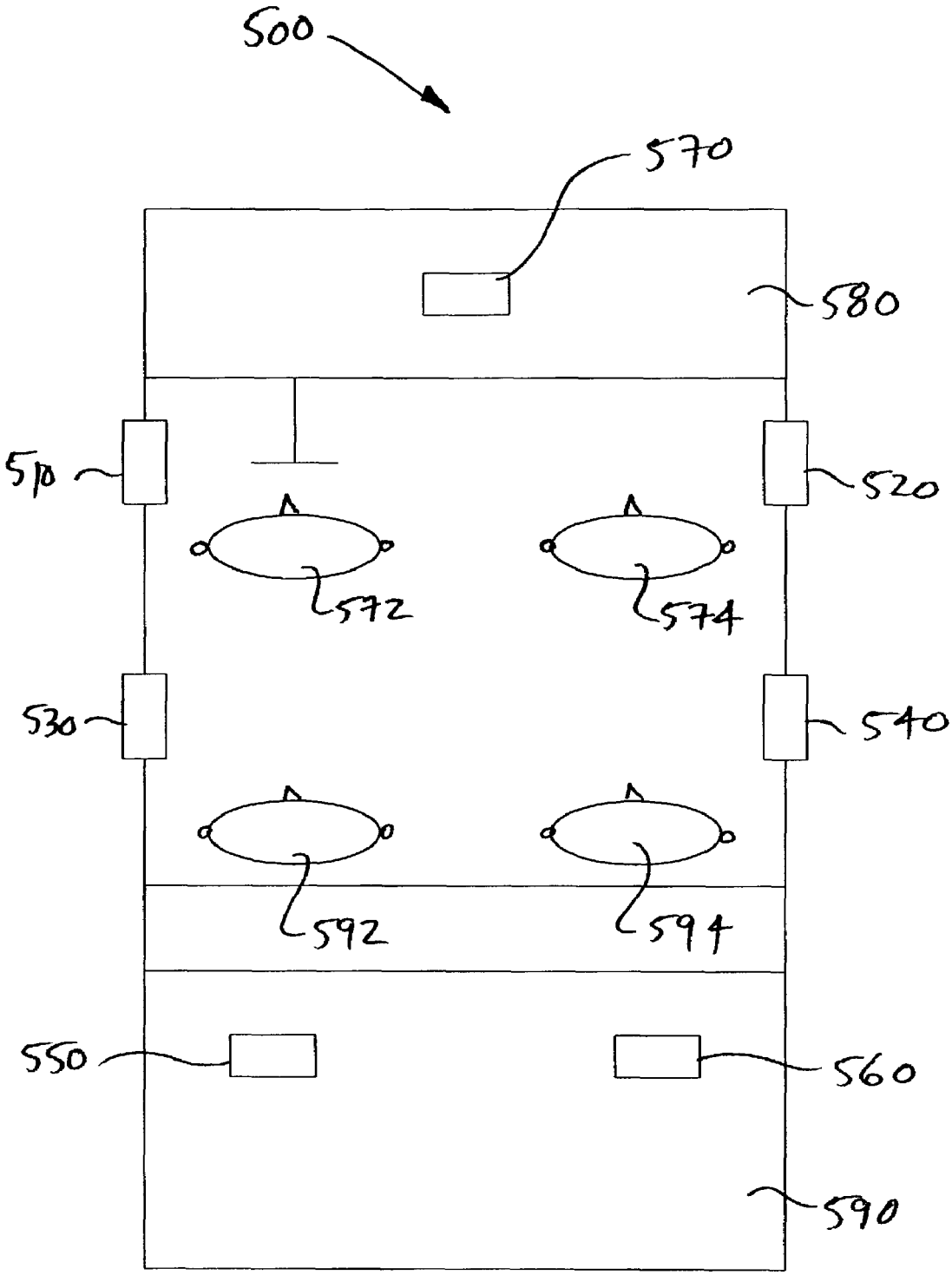
FIG. 5 is a block diagram showing a top view of a layout for a seven-channel automobile audio system.

FIG. 5 is a block diagram showing a top view of a layout for a seven-channel automobile audio system 500. The seven output channels may be sent to a left front speaker 510, a right front speaker 520, a left side speaker 530, a right side speaker 540, a left rear speaker 550, a right rear speaker 560 and a center channel speaker 570. The front left speaker 510 and the front right speaker 520 may be located in a forward part of the front doors, to the left and right of the driver 572 and front passenger 574. The center channel speaker 570 may be located in the center of a dashboard 580. The left side speaker 530 and the right side speaker 240 may be located in a forward part of the rear doors. The left rear speaker 550 and the right rear speaker 560 may be located in a panel 590 located behind the heads of the rear passengers 592, 594.

Figure 6:
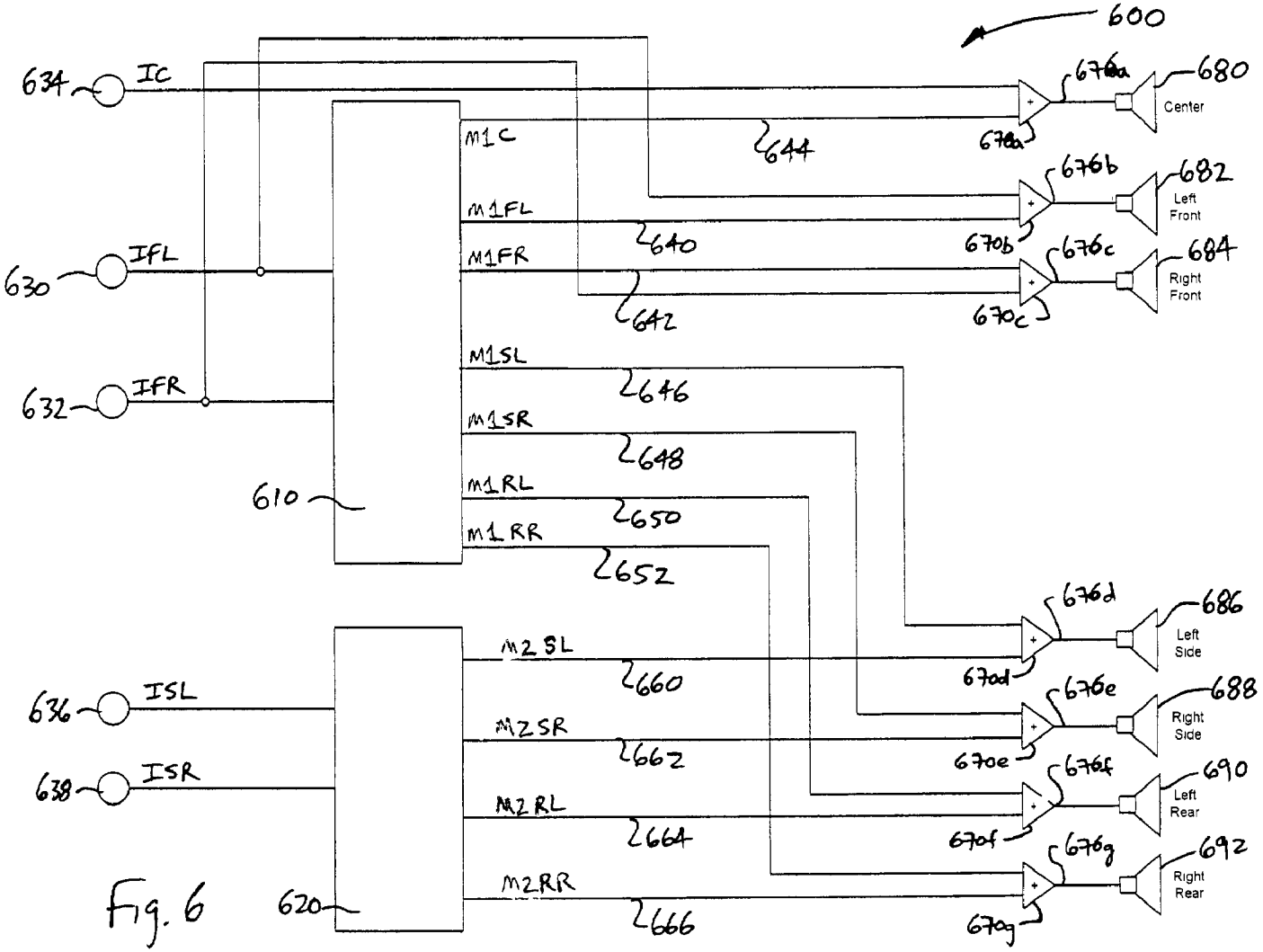
FIG. 6 is a block diagram of a circuit for mixing a five-channel input signal to a seven-channel audio output signal.

FIG. 6 is a block diagram of a sound processing system 600 for mixing five-channel input signals to produce seven-channel audio output signal. The five-channel to seven-channel conversion system may utilize two active surround matrices, a first matrix 610 and a second matrix 620. An example first matrix receives two signals (e.g., input front left and input front right) and outputs seven signals (e.g., center, front left, front right, side left, side right, rear left and rear right), as described in more detail below. An example second matrix receives two signals, e.g., input surround left and input surround right, and outputs five signals, e.g., side left, side right, center, rear left and rear right, and a subwoofer signal. Other matrices or mixers to enhance the perception of sound may be used.

The system 600 may be implemented with firmware, hardware or software, or any combination of firmware, software or hardware. While a configuration having five input channels and seven output channels is shown, other multiples of input channels and output channels may be used. Using the circuit 600, a commercial five-channel reproduction media such as Dolby Digital, AC-3, DTS, MLP, etc. may be converted to a seven-channel output. The five-channel to seven-channel conversion may make the localization and the spatial illusion of the output sound more robust. The system may allow for an enlarged listening area, tolerance for non-ideal speaker placement, heightened spatial illusion, and the ability to overcome shortcomings in the original recorded material.

Combining the two matrices may be optimized for an automobile or home environment. Also, other amounts of channels may be converted, such that a single or multi-channel signal may be converted to another single or multi-channel signal using at least one sound matrix. The matrices 610 and 620 may be implemented with one or more matrices. For example, a single matrix could be used that combines the algorithms of the first and second matrices. The matrices may be implemented with hardware, software or firmware, and may include multiplexers, logic elements, and the like. The matrices may be included on one or more chips.

As shown in FIG. 6, the original input signals to be converted may include may include one or more inputs such as an input front left (IFL) 630, an input front right (IFR) 632, an input center (IC) 634, an input surround left (ISL) 636, and an input surround right (ISR) 368. To convert from an original format to a seven-channel system, any combination of input signals may be used, including more or less than five input channels.

Referring to FIG. 6, the first matrix accomplishes a two-channel to seven channel conversion. For example, the first matrix may be applied to the input front left 630 and input front right 632 discrete channels of the surround sound mixer. The first matrix derives seven output channels from the two input channels, input front left 630 and input front right 632. The output channels include left front output (M1FL) 640, front right output (M1FR) 642, center output (M1C) 644, side left output (M1SL) 646, side right output (M1SR) 648, rear left output (M1RL) 650, and rear right output (652).

The first matrix may be modified to ignore conditions when the inputs IFL and IFL are out of phase, treating this condition as if the front two-channels were decorrelated. In this way, the two-channel to seven-channel matrix may only actively direct sound to the front of the sound image. When out of phase information in the input exists, the sound may be directed more or less equally to the outputs, for example, to all the outputs. The out of phase component may also be de-emphasized.

In addition to the two-channel to seven-channel conversion, the second matrix 620 may be applied to the input surround left (ISL) 636 and input surround right (ISR) 638 incoming signals, to accomplish a two-channel input to four-channel output conversion. The second matrix 620 output channels may include a side left output (M2SL) 660, a side right output (M2SR) 662, a rear left output (M2RL) 664, and a rear right output (M2RR) 666.

When the input ISL is much stronger than the input ISR (and in-phase), the output may be almost all from the left side output. As the level in the right channel increases, the level in the left rear output increases and the level in the left side output decreases. When the two inputs include the ratio of (0.91)/(0.38) the output may exist entirely in the left rear output. As the level in the right input continues to rise, the output in the left side output remains low, and the output in the right rear output rises, until when the two inputs are equal, the left rear and the right rear outputs are also equal. The inputs may not be correlated (no common elements). The left input may be sent to the left side and the left rear equally, with a delay between side and rear outputs. A shelving filter or rolloff may also be used. The matrix may also be programmed so that, when the input signals are out of phase, the matrix reacts as if the signals were uncorrelated.

Both the second matrix and the first matrix may include a preview delay and other delays (not shown). The output signals of the second matrix and the first matrices may be synchronized in time by using the internal delays. For example, the first matrix may use a preview delay of about 2 to 10 ms, so the second may include a similar delay. The preview delay may be used so that matrix settings and values may be calculated in advance of the output. The preview delay may allow the input signals to be averaged to determine direction and the output to be directed correctly.

The output from the first matrix, the output from the second matrix, and the input signals 630, 632, 634 are combined using summers 670*a-g* to form seven output channels 676*a-g*. The summers 670*a-g* may also be used to combine signals in other ways, such as by including input signals 636, 638.

M1C 644 is mixed with IC 634 and sent to a center loudspeaker 680. M1FL 640 is mixed with IFL 630 and sent to the front left speaker 682. M1FR 642 is mixed with IFR 632 and sent to the front right speaker 684. M1SL 646 is mixed with M2SL 660 and sent to the side left speaker 686. M1SR 648 is mixed with M2SR 662 and sent to the side right speaker 688.

M1RL 650 is mixed with M2RL 664 and sent to the rear left loudspeaker 690. M1RR 652 is mixed with M2RR 666 and sent to the rear right loudspeaker 692. There may be an adjustable gain for each of the signals at each mixing point, so the relative levels may be adjusted by the listener and/or implementer of the system.

Figure 7:
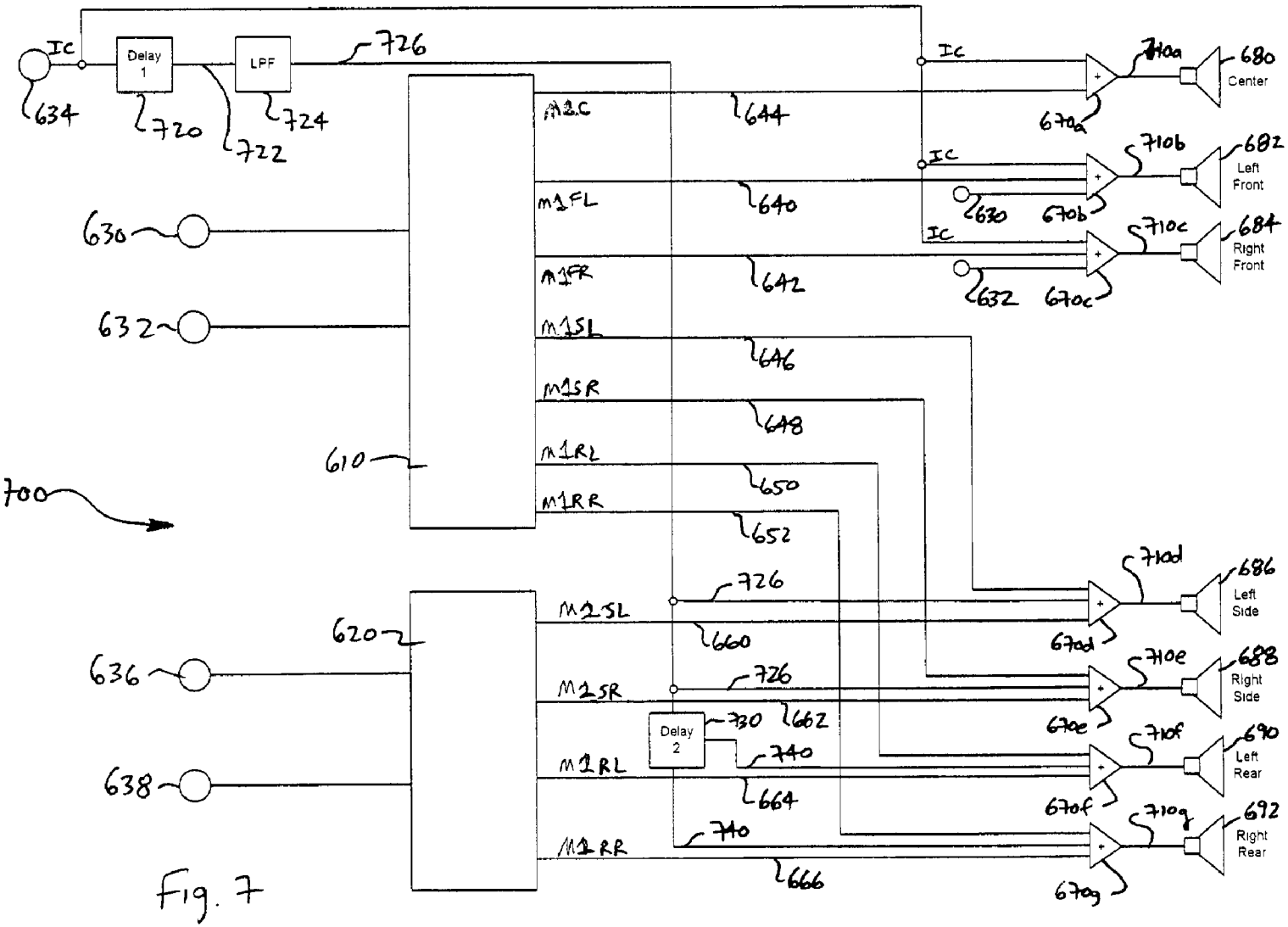
FIG. 7 is a block diagram of another circuit for mixing audio input signals to a seven-channel audio output signals.

FIG. 7 is a block diagram of another sound processing system 700 for mixing audio input signals to produce seven-channel audio output signals 710*a-g*. The system 700 may be used in an automotive application, but is not limited to automotive applications. The first matrix 610 includes a first delay 720 between the side outputs M1SL, M1SR and the front outputs M1FL, M1FR, and another delay 730 between the front outputs M1FL, M1FR and the rear outputs M1RL, M1RR.

Therefore, regarding system 700, IC 634 may be delayed using a first delay element 720 to match the delay of M1SL and M1SR, and then added to the signal which is sent to the side left loudspeaker 686 and side right loudspeaker 688. The delay of M1SL and M1SR may be typically about 10 ms. Before the first delayed signal 722 is mixed, the first delayed signal 722 may be processed through a low-pass filter 724 to produce a delayed low pass filtered signal 726. An adjustable off-the-shelf filter may be used to remove at least some of the very high frequencies. Low-pass filter values may include about a 6 kHz, single pole low-pass filter, including 6 dB per octave.

An adjustable gain may be provided for any of the summers, such as summers 670*d* and 670*e*. The delayed low-pass filtered signal 726 may be additionally delayed using delay element 730 to match the delay of the M1RL and M1RR signals. Delay element 730 may include a typical delay of 10 to 20 ms in addition to the first delay from the first delay element 720. The output signal 740 of the second delay element 730 may be added to the summers 670*f* and 670*g*. The summers outputs 710*f* and 710*g* connect with the rear left speaker 690 and the rear right speaker 692. The additional mix points may provide some of the center channel sound to the rear passengers 592, 594 (FIG. 5). The rear passengers hear the signals from IC 634 from all around them, but predominantly from the center speaker. Additionally, since the driver 572 and the front passenger 574 may hear the delayed center sound from behind them, the effect on the front listeners may be to add apparent distance to the center image. An illusion that these sounds are arriving from the front may result, which may be desired.

IC 634 also may be added to the inputs of the front left speaker 682 and the front right speaker 684, e.g., at a low level, such as at about −4 dB to −6 dB. A signal that is present in IC 634 may therefore be heard as emanating more from the front of both the driver 572 and the passenger 574.

When the incoming signals have a phantom center image, e.g., no central sound is present in the IC channel 634, the first matrix may be designed to automatically derive the center channel signal, and the mixing into the front left and right, the side left and right, and the rear left and right are handled automatically by the design of the first matrix. Therefore, combining the first matrix with the discrete signals as described above, may provide for a robust playback. Center signals may be localized throughout the automobile, regardless of whether or not the original recording used a center channel.

The second matrix additionally operates on the ISL 636 and ISR 638 to derive four outputs, and these outputs may be directed to the sides and the rear of the listeners. The spatial effect for the rear passengers 592, 594 may be improved by the additional delay that is added by the second matrix to the rear channels. Full left/right separation may be maintained for all reverberant or ambient signals. When discrete sounds exist in ISL 636 and/or ISR 638, these sounds may be placed slightly to the rear of the rear passengers 592, 594. Often mixers place sounds equally in ISL 636 and ISR 638, intending these sounds to sound fully behind the listener. The second matrix detects these sounds, and places the high frequencies predominantly located in the rear channels, but maintains the low frequencies in both channels. The result may be both convincing and enveloping, and allow a somewhat smaller speaker to be used behind the listeners if desired.

The first and the second matrices may be designed to maximize the spatial effect of the output signals. The amount of decorrelation in the signals may be increased at all frequencies, and the high and low pass filters may be applied to maximize the surround effect around the listeners. Combining the first and second matrices with the original signals in the way described may improve the robustness of the localization experience, and the envelopment of the spatial experience.

The input channels may be passed through a crossover network before being applied to the matrix. The crossover is a 6 dB per octave high pass and low pass, with a crossover frequency of about 150 Hz. The HF output of the crossover may be sent to the matrix where steering takes place. The LF output of the crossover may be passed directly to the outputs without modification. The LF on the left front input to the decoder is sent more or less equally to the left front output, the left side output, and the left rear output. The delay in each channel in the LF may be adjusted to match the delay in the HF, so the LF and the HF recombine with no interference.

The amplitude ratios may be adjusted to match the power handling capabilities of the particular speakers used in the output channels, in principle the energy division is equal. The right input is similarly sent to the three right outputs. Separation between left and right may be maintained in the LF. Although the degree of correlation between the various bass drivers may be audible, the direction of the sound is usually not audible. The LF is sent to all the drivers, while maintaining as much decorrelation as possible. Additionally, rapid steering of various signals in the matrices may be for the HF signals, but when the same steering is applied to the LF at the same time, audible artifacts may result. Thus using a crossover is a simple technique of making a multiband matrix, and the resulting sound output may be superior to a single band matrix.

When the two surround inputs are equal or stronger than the surround outputs derived through the two-channel to seven-channel matrix from the front channels, the derived channels may be attenuated, for example, up to 3 dB. The attenuation may prevent reverberation build-up in the rear speakers. If the input surround channels from the original recording are too weak, the derived rear channel energy to the rear outputs of the device may improve the overall impression of the recording.

While various embodiments of the invention have been described, it will be apparent to those of ordinary skill in the art that may more embodiments and implementations are possible that are within the scope of the invention.

What is claimed is:

1. A sound processing system for receiving a plurality of input signals and for generating output signals for a plurality of output channels, the sound processing system comprising:

a first matrix generates first output signals for the plurality of output channels in response to at least two first input signals, the first matrix having first dimensions for a number of inputs to a number of outputs, the number of inputs for the first matrix comprising at least two inputs;

a second matrix generates at least one second output signal for at least one of the plurality of output channels in response to at least two second input signals, the second matrix having second dimensions for a number of inputs to a number of outputs, the number of inputs for the second matrix comprising at least two inputs, where the first matrix and the second matrix operate in parallel to one another; and at least one combiner in communication with the first matrix and the second matrix, the combiner generates signals for at least some of the plurality of the output channels for the sound processing system in response to the first output signals and the second output signals, where the first matrix generates a first signal for output on a particular output channel;

where the second matrix generates a second signal for output on the same particular output channel;

where none of the one or more input signals used to generate the first signal are used to generate the second signal;

where the combiner combines the first signal for output on the particular output channel from the first matrix with the second signal for output on the particular output channel from the second matrix in order to generate a signal for the particular output channel; and where a sum of the number of outputs of the first matrix and the number of outputs of the second matrix is greater than a number of all of the plurality of the output channels of the sound processing system.

2. The sound processing system of claim 1 where at least one of the first input signals and the second input signals comprise a decoded signal.

3. The sound processing system of claim 1 where at least one of the first input signals and the second input signals comprise a recorded signal.

4. The sound processing system of claim 1 where the at least two first input signals consist a left front signal and a right front signal.

5. The sound processing system of claim 1 where the at least two second input signals consist a surround left signal and a surround right signal.

6. The sound processing system of claim 1 where the first output signals comprise a front left signal, a front right signal, a left side signal, a right side signal, a left rear signal and a right rear signal.

7. The sound processing system of claim 1 where the combiner comprises a signal adder.

8. The sound processing system of claim 1 where the first matrix has a first number of outputs;

where the second matrix has a second number of outputs; and where the first number of outputs is different from the second number of outputs.

9. The sound processing system of claim 8 where the second matrix has no common inputs with the first matrix.

10. The sound processing system of claim 1, where the first matrix is configured to perform an arithmetic operation on at least one of the first input signals; and where the second matrix is configured to perform an arithmetic operation on at least one of the second input signals.

11. The sound processing system of claim 10, where the first matrix is a first surround matrix; and where the second matrix is a second surround matrix.

12. The sound processing system of claim 1, where the number of inputs for the first matrix is different from the number of outputs for the first matrix; and where the number of inputs for the second matrix is different from the number of outputs for the second matrix.

13. The sound processing system of claim 1, where the at least two first input signals of the first matrix are combined to form the first output signals of the first matrix; and where the at least two second input signals of the second matrix are combined to form the second output signals of the second matrix.

14. The sound processing system of claim 1, where the number of outputs of the first matrix is equal to the number of output channels of a surround sound system.

15. The sound processing system of claim 1, where the number of outputs for the first matrix is greater than the number of outputs for the second matrix.

16. The sound processing system of claim 15, where there are no common inputs to the first matrix and the second matrix.

17. The sound processing system of claim 16, where the first input signals to the first matrix consist of a left front input and a right front input.

18. The sound processing system of claim 17, where the second input signals to the second matrix consist of a left surround input and a right surround input.

19. The sound processing system of claim 17, where the first matrix generates output signals for each of the plurality of output channels.

20. The sound processing system of claim 19, where the plurality of output channels comprises X number of channels where; X>1 and where the number of outputs of the first matrix comprises X outputs.

21. A sound processing system comprising:

a first matrix decoder generates at least one first output signal in response to at least two first input signals, the first matrix decoder having first dimensions for a number of inputs to a number of outputs, the number of inputs for the first matrix decoder comprising at least two inputs;

a second matrix decoder generates at least one second output signal in response to at least two second input signals, the second matrix decoder having second dimensions for a number of inputs to a number of outputs, the number of inputs for the second matrix decoder comprising at least two inputs where the first matrix decoder and the second matrix decoder operate in parallel to one another; and at least one summer in communication with the first matrix decoder and the second matrix decoder, the summer generates a speaker signal in response to the at least one first output signal and the at least one second output signal, where at least part of the first dimensions is different from at least part of the second dimensions, where at least one of the at least two first input signals and at least one of the at least two second input signals.

22. A sound processing system comprising:

a first matrix that operates on an input left front signal and an input right front signal to produce a first set of outputs;

a second matrix that operates on an input surround left signal and an input surround right signal to produce a second set of outputs, with the second matrix not operating on any input signals that are input to the first matrix, where the first matrix and the second matrix operate in parallel to one another; and where the first matrix generates a first signal for output on a particular output channel;

where the second matrix generates a second signal for output on the same particular output channel;

where none of the signals used to generate the first signal are used to generate the second signal;

where the first signal for output on the particular output channel from the first matrix is combined with the second signal for output on the particular output channel from the second matrix in order to generate a signal for the particular output channel, where a sum of a number of the first set of outputs from the first matrix and a number of the second set of outputs from the second matrix is greater than a number of all of the plurality of the output channels of the sound processing system.

23. The system of claim 22 where the first signal for output on a particular output channel comprises a first surround left signal and the second signal for output on a particular output channel comprises a second surround left signal, and where the combiner combines the first surround left signal and the second surround left signal to produce a left side speaker signal.

24. The system of claim 22 where the first signal for output on a particular output channel comprises a first rear left signal and the second signal for output on a particular output channel comprises a second rear left signal, and where the combiner combines the first rear left signal and the second rear left signal to produce a left rear speaker signal.

25. The system of claim 22 where the first set of outputs comprises a front left signal.

26. The system of claim 25 where the combiner receives an input center signal, and where the combiner combines the front left signal with the input center signal.

27. The system of claim 22 where the first set of outputs comprises a front right signal.

28. The system of claim 27 where the combiner receives an input center signal, and where the combiner combines the front right signal with the input center signal.

29. The system of claim 28 where the first set of outputs comprises a center signal.

30. The system of claim 29 where the combiner receives an input center signal, and where the combiner combines the input center signal with the center signal from the first set of outputs.

31. A sound processing system comprising:

a first two-channel to multi-channel matrix that operates on an input left front signal and an input right front signal to produce a first set of outputs;

a second two-channel to multi-channel matrix that operates on an input surround left signal and an input surround right signal to produce a second set of outputs, with the second two-channel matrix not operating on the input left front signal or the input right front signal where the first two-channel to multi-channel matrix and second two-channel to multi-channel matrix operate in parallel to one another; and at least one combiner combines the first set of outputs with at least one of the second set of outputs to produce a third set of outputs for at least one of a plurality of output channels for the sound processing system, where the first two-channel to multi-channel matrix generates a first signal for output on a particular output channel;

where the second two-channel to multi-channel matrix generates a second signal for output on the same particular output channel;

where none of the signals used to generate the first signal are used to generate the second signal;

where the combiner combines the first signal for output on the particular output channel from the first matrix with the second signal for output on the particular output channel from the second matrix in order to generate a signal for the particular output channel; and where a sum of a number of the first set of outputs from the first two-channel to multi-channel matrix and a number of the second set of outputs from the second two-channel to multi-channel matrix is greater than a number of all of the plurality of the output channels of the sound processing system.

32. The system of claim 31 further comprising a first delay circuit to produce a delayed input center signal.

33. The system of claim 32 further including low pass filter in communication with the first delay circuit to produce a filtered and delayed input center signal.

34. The system of claim 33 where the first set of outputs comprises a first surround left signal and the second set of outputs comprises a second surround left signal.

35. The system of claim 34 where the combiner combines the filtered and delayed input center signal with the first surround left signal and the second surround left signal.

36. The system of claim 33 where the first set of outputs comprises a first surround right signal and the second set of outputs comprises a second surround right signal.

37. The system of claim 36 where the combiner combines the filtered and delayed input center signal with the first surround right signal and the second surround right signal.

38. The system of claim 33 further including a second delay circuit in communication with the low pass filter to produce a twice delayed and filtered input center signal.

39. The system of claim 38 where the first set of outputs comprises a first rear left signal and the second set of outputs comprises a second rear left signal.

40. The system of claim 39 where the combiner combines the twice delayed and filtered input center signal with the first rear left signal and the second rear left signal.

41. The system of claim 40 where the first set of outputs comprises a first rear right signal and the second set of outputs comprises a second rear right signal.

42. The system of claim 41 where the combiner combines the twice delayed and filtered input center signal with the first rear right signal and the second rear right signal.

43. The system of claim 33 where the combiner receives an input center signal, and where the summer combines the input center signal with the center signal of the first set of outputs.

44. The system of claim 31 where the first set of outputs comprises a center signal.

45. The system of claim 31 where the first set of outputs comprises a front left signal.

46. The system of claim 45 where the combiner receives an input center signal, and where the summer combines the input center signal with the front left signal.

47. The system of claim 31 where the first set of outputs comprises a front right signal.

48. The system of claim 47 where the combiner receives an input center signal, and where the summer combines the input center signal with the front right signal.

49. The system of claim 31 where the first two-channel to multi-channel matrix comprises a two channel to seven-channel matrix.

50. The system of claim 49 where the second two-channel to multi-channel matrix comprises a two-channel to four-channel matrix.

51. A method for providing audio output signals for a sound processing system comprising:

producing a first set of outputs in response to an input front left signal and an input front right signal, at least one of the first set of outputs for a particular output channel;

producing, in parallel with the production of the first set of outputs, a second set of outputs in response to an input surround left signal and an input surround right signal, the second set of outputs not being dependent on the input front left signal or the input front right signal, at least one of the second set of outputs for the same particular output channel, where none of the signals used to produce the one of the first set of outputs are used to generate the one of the second set of outputs; and combining the first set of outputs and the second set of outputs to produce a third set of outputs for at least some of a plurality of output channels for the sound processing system with the one of the first set of outputs for the particular output channel being combined with the one of the second set of outputs for the particular output channel, where a sum of a number of the first set of outputs and a number of the second set of outputs is greater than a number of all of the plurality of the output channels of the sound processing system.

52. The method of claim 51 where the first set of outputs comprises a first surround left signal and the second set of outputs comprises a second surround left signal.

53. The method of claim 52 further including:

delaying a center signal;

filtering the input center signal; and summing the center signal with the first surround left signal and the second surround left signal.

54. The method of claim 51 where the first set of outputs comprises a first surround right signal and the second set of outputs comprises a second surround right signal.

55. The method of claim 54 further including:

delaying a center signal;

filtering the center signal; and summing the center signal with a first surround right signal and a second surround right signal.

56. The method of claim 51 where the first set of outputs comprises a first rear left signal and the second set of outputs comprises a second rear left signal.

57. The method of claim 56 further including:

delaying a center signal;

filtering the center signal;

delaying the filtered center signal; and summing the center signal with a first rear left signal and a second rear left signal.

58. The method of claim 51 where the first set of outputs comprises a first rear right signal and the second set of outputs comprises a second rear right signal.

59. The method of claim 58 further including:

delaying a center signal;

filtering the center signal;

delaying the filtered center signal; and summing the center signal with a first rear right signal and a second rear right signal.

60. The method of claim 51 where the first set of outputs comprises a surround center signal.

61. The method of claim 60 further including mixing an input center signal with the surround center signal to produce an output signal.

62. The method of claim 51 where the first set of outputs comprises a front left signal and a front right signal.

63. The method of claim 62 further including mixing an input center signal with the front left signal and the front right signal

64. A sound processing system comprising:

a least one matrix, the matrix receives an input front left signal and an input front right signal and to output a first set of output signals, and receives an input side left signal and an input side right signal and to output a second set of output signals, the second set of output signals not being dependent on the input front left signal or input front right signal; and at least one combiner combines the first set of output signals with the second set of output signals to generate signals for at least some of a plurality of output channels for the surround sound system, where a sum of the number of the first set of output signals and the second set of output signals is greater than a number of all of the plurality of the output channels of the sound processing system, where at least one of the first set of output signals comprises a first signal for output on a particular output channel;

where at least one of the second set of output signals comprises a second signal for output on the same particular output channel;

where none of the signals used to generate the first signal are used to generate the second signal; and where the second set of output signals is produced in parallel with the first set of output signals.

65. The sound processing system of claim 64 where the first signal comprises a first surround left signal and the second signal comprises a second surround left signal, and where the combiner combines the first surround left signal and the second surround left signal to produce a left side speaker signal.

66. The sound processing system of claim 64 where the first signal comprises a first rear left signal and the second signal comprises a second rear left signal, and where the combiner combines the first rear left signal and the second rear left signal to produce a left rear speaker signal.

67. The sound processing system of claim 64 where the first set signal comprises a first rear right signal and the second signal comprises a second rear right signal, and where the combiner combines the first rear right signal and the second rear right signal to produce a right rear speaker signal.

68. The sound processing system of claim 67 where the first set of output signals comprises a front left signal.

69. The sound processing system of claim 68 where the summer receives an input center signal, and where the summer combines the front left signal with the input center signal.

70. The sound processing system of claim 64, where the first set of output signals comprises a front right signal.

71. The sound processing system of claim 70 where the summer receives an input center signal, and where the summer combines the front right signal with the input center signal.

72. The sound processing system of claim 64 where the first set of output signals comprises a center signal.

73. The sound processing system of claim 64 where the summer receives an input center signal, and where the summer combines the input center signal with the center signal from the first set of output signals.

74. A method for providing audio output signals for a sound processing system comprising:

generating, using a first matrix, at least one first output signal for a particular output channel in response to at least two first input signals, the first matrix having first dimensions for a number of inputs to a number of outputs, the number of inputs for the first matrix comprising at least two inputs;

generating, in parallel to generating the at least one first output signal using a second matrix, at least one second output signal for the same particular output channel in response to at least two second input signals, the second matrix having second dimensions for a number of inputs to a number of outputs, the number of inputs for the second matrix comprising at least two inputs; and combining the at least one first output signal and the at least one second output signal to generate at least one speaker signal for the particular output channel for the sound processing system, where none of the input signals used to generate the at least one first output signal are used to generate the at least one second output signal;

where a sum of the number of outputs of the first matrix and the number of outputs of the second matrix is greater than a number of all of the plurality of the output channels of the sound processing system.

75. The method of claim 74, where the first matrix has a first number of outputs;

where the second matrix has a second number of outputs; and where the first number of outputs is different from the second number of outputs.

76. The method of claim 75, where the second matrix has no common inputs with the first matrix.

77. The method of claim 76, where the number of outputs of the first matrix is different from the number of outputs of the second matrix.

* * * * *

UNITED STATES PATENT AND TRADEMARK OFFICE

CERTIFICATE OF CORRECTION

PATENT NO. : 7,443,987 B2
APPLICATION NO. : 10/254031
DATED : October 28, 2008
INVENTOR(S) : David H. Griesinger It is certified that error appears in the above-identified patent and that said Letters Patent is hereby corrected as shown below:

On the Title Page

Item (57), line 5, under "ABSTRACT", after "matrices produce" delete "outputs" and substitute --output-- in its place.

Column 10, claim 21, lines 53 and 54, delete "summer" and substitute --combiner-- in its place (both occurrences).

Column 12, claim 43, line 53, after "and where the" delete "summer" and substitute --combiner-- in its place.

Column 12, claim 46, line 60, after "and where the" delete "summer" and substitute --combiner-- in its place.

Column 12, claim 48, line 65, after "and where the" delete "summer" and substitute --combiner-- in its place.

Column 13, claim 53, line 38, before "the center signal" delete "summing" and substitute --combining-- in its place.

Column 13, claim 55, line 46, before "the center signal" delete "summing" and substitute --combining-- in its place.

Column 13, claim 57, line 55, before "the center signal" delete "summing" and substitute --combining-- in its place.

Column 13, claim 59, line 64, before "the center signal" delete "summing" and substitute --combining-- in its place.

UNITED STATES PATENT AND TRADEMARK OFFICE

CERTIFICATE OF CORRECTION

PATENT NO. : 7,443,987 B2
APPLICATION NO. : 10/254031
DATED : October 28, 2008
INVENTOR(S) : David H. Griesinger It is certified that error appears in the above-identified patent and that said Letters Patent is hereby corrected as shown below:

Column 14, claim 64, line 10, before "one matrix," delete "a least" and substitute --at least-- in its place.

Column 14, claim 69, lines 54-55, delete "summer" and substitute --combiner-- in its place.

Column 14, claim 71, lines 59-60, delete "summer" and substitute --combiner-- in its place.

Column 14, claim 73, lines 65-66, delete "summer" and substitute --combiner-- in its place.

Signed and Sealed this

Thirtieth Day of June, 2009

John Doll

JOHN DOLL
*Acting Director of the United States Patent and Trademark Office*